US012397892B2

(12) United States Patent
Zhao et al.

(10) Patent No.: US 12,397,892 B2
(45) Date of Patent: Aug. 26, 2025

(54) PROPELLER

(71) Applicant: INNO Instrument America, Inc., Dallas, TX (US)

(72) Inventors: Yangri Zhao, Dallas, TX (US); Jiping Zhang, Dallas, TX (US)

( * ) Notice: Subject to any disclaimer, the term of this patent is extended or adjusted under 35 U.S.C. 154(b) by 0 days.

(21) Appl. No.: 18/799,641

(22) Filed: Aug. 9, 2024

(65) Prior Publication Data

US 2024/0400183 A1 Dec. 5, 2024

(30) Foreign Application Priority Data

May 30, 2024 (CN) ..... 202410687312.8

(51) Int. Cl.

| | |
|---|---|
| ***B63H 21/17*** | (2006.01) |
| ***A63B 35/12*** | (2006.01) |
| ***B63B 32/10*** | (2020.01) |
| ***B63B 32/60*** | (2020.01) |
| ***B63B 32/66*** | (2020.01) |
| ***B63C 11/46*** | (2006.01) |
| ***B63H 1/14*** | (2006.01) |
| ***B63H 11/08*** | (2006.01) |
| *B63C 11/02* | (2006.01) |

(52) U.S. Cl.

CPC ..... *B63H 21/17* (2013.01); *A63B 35/12* (2013.01); *B63B 32/10* (2020.02); *B63B 32/60* (2020.02); *B63B 32/66* (2020.02); *B63C 11/46* (2013.01); *B63H 1/14* (2013.01); *B63H 11/08* (2013.01); *B63C 2011/028* (2013.01)

(58) Field of Classification Search

CPC .... B63H 21/17; B63H 1/14–28; B63H 11/04; B63H 11/08; B63B 32/10; B63B 32/60; B63B 32/66; A63B 35/12; B63C 2011/028; B63C 11/46

See application file for complete search history.

(56) References Cited

U.S. PATENT DOCUMENTS

| | | | | |
|---|---|---|---|---|
| 3,757,721 | A * | 9/1973 | Ohishi | A63B 35/12 114/338 |
| 5,105,753 | A * | 4/1992 | Chih | A63B 35/12 440/6 |
| 7,207,282 | B1 * | 4/2007 | Ruan | B63C 11/46 441/74 |
| 10,300,998 | B2 * | 5/2019 | Terada | B63H 21/17 |
| 10,960,269 | B1 * | 3/2021 | Lu | B63H 23/02 |
| 11,180,226 | B2 * | 11/2021 | Jensen | B63H 21/21 |
| 11,814,149 | B2 * | 11/2023 | Liu | B63C 11/46 |
| 12,071,203 | B2 * | 8/2024 | Mines | B63B 32/40 |

* cited by examiner

*Primary Examiner* — Loren C Edwards
(74) *Attorney, Agent, or Firm* — Addison D. Ault; IPGentleman Intellectual Property Services, LLC

(57) ABSTRACT

Disclosed is a propeller, including a main driving device. Foldable blades and a fixed propeller are detachably connected to a projecting shaft of a driving motor. When the foldable blades are arranged, the propeller can be used as a hydrofoil board booster, and be clamped to a vertical rod of the hydrofoil board. When a fixed propeller is surrounded by a water flow culvert pipe provided with water inlet grooves, the propeller can be handheld with a handheld bracket or worn to advance and play underwater. Further, the propeller can be used as a guiding device for a diving apparatus. In combination with a gas cylinder and an airbag, the propeller can also be used as a scuba gear. Together with movable and fixed hydrofoil boards, the propeller can also be used as a gliding apparatus for diving.

8 Claims, 8 Drawing Sheets

PROPELLER

TECHNICAL FIELD

The present disclosure relates to the technical fields of underwater propellers, electric assist apparatuses for hydrofoil boards, and electric assist electric assist for diving, and particularly relates to a propeller.

BACKGROUND

Underwater propellers, electric assist apparatuses for hydrofoil boards, and electric assist electric assist for diving in the prior art have the following disadvantages:

a. Existing handheld underwater propellers, non-powered hydrofoil board boosters, and diving assist devices can only be used in single scenarios, and usage scenarios cannot be easily and flexibly switched. Handheld underwater propellers cannot be used together with other sports equipment, while hydrofoil board boosters cannot be handheld or bound. Therefore, users have to buy three different types of equipment, thereby causing a lot of waste.

b. Existing non-powered hydrofoil boards (including hydrofoil boards, hydrofoil wind wing boards, hydrofoil wind surfing boards, hydrofoil paddle boards, and the like) can be propelled only by wind or manpower, which raises relatively strict requirements for physical fitness and endurance of users. In fact, it is difficult for ordinary people and beginners to master this sports skill. When the wind is too weak or it is against the wind, a non-powered hydrofoil board cannot be used normally. Only after being transferred to a windy area by manpower can the non-powered hydrofoil board be used.

c. Existing portable underwater propellers that can be carried on airplanes can only provide an electricity output of no more than 100 WH and an endurance of usually no longer than 40 min, so that use needs cannot be satisfied. Large capacity batteries cannot be conveniently carried on airplanes, and it is inconvenient for users to carry them during long-distance travel.

To solve the above problems, it is necessary to optimize and improve structures of underwater propellers.

SUMMARY

(I) Technical Problems

To overcome defects in the prior art, the present disclosure provides a propeller, to solve the problems in the prior art that propellers are used in single scenarios and on-powered hydrofoil boards lack auxiliary power and fail to meet requirements in battery capacities.

(II) Technical Solution

In order to achieve the above objective, the present disclosure is achieved by the following technical solution: a propeller, including a main driving device, where a driving motor is arranged on an inner wall of the main driving device, an end portion of a projecting shaft of the driving motor penetrates through a left end of the main driving device and extends towards a left side of the main driving device, and a propulsion structure driven by the driving motor is arranged at the left end of the main driving device; the propulsion structure can be detached; an end of the main driving device away from the propulsion structure, through a locking ring, is connected to a battery cylinder body in a threaded manner, an end of the battery cylinder body away from the main driving device is connected to a bottom cover in a threaded manner, and battery cells are arranged on an inner side wall of the battery cylinder body; a control panel is arranged on a front wall of the main driving device, a display screen and an electrical interface are sequentially arranged on a front wall of the control panel from left to right, and the electrical interface is provided with an accelerator control device for controlling the accelerator; a groove is formed between a rear wall of the main driving device and the control panel that are opposite to each other from front to back, an inner side wall of the groove is fixedly connected with a clamping plate component through screws, and a fixing block is arranged on a rear wall of the clamping plate component; and one side of the fixing block away from the clamping plate component is detachably connected to a movable block.

Preferably, two second clamping buckles that are distributed one above the other are arranged on a side of the fixing block away from the clamping plate component, and a second hook is arranged at ends of the two second clamping buckles that are opposite to each other and away from the fixing block. A first sink is arranged on a side of the movable block facing the fixing block, two second sinks are arranged on an inner rear wall of the first sink, and the two second sinks are distributed one above the other. An inner side wall of either of the two second sinks is slidably connected to a pressing block, and reverse ends of the two pressing blocks respectively penetrate through an upper wall and a lower wall of the movable block and extend towards an upper side and a lower side of the movable block. A first clamping buckle is arranged on a front wall of either of the two pressing blocks and at a position close to an opposite end thereof, both two first clamping buckles extend into the inside of the first sink, and a first hook that matches the second hook on the second clamping buckle is arranged on a reverse side of either of the two first clamping buckles 31 and an end away from the pressing block. A spring is arranged between an opposite end of either of the two pressing blocks and the inner side wall of the second sink. The movable block is detachably connected to the fixing block through the two first clamping buckles and the two second clamping buckles. A side of the movable block away from the fixing block can be connected to a common diving apparatus through screws, and quick assembly and disassembly of the propeller with the diving apparatus can be achieved through a detachable connection between the movable block and the fixing block.

Preferably, the battery cylinder body varies in length: long, medium, and short, and three, two or one battery cells are arranged inside the long, medium or short battery cylinder body, respectively.

Preferably, the propulsion structure includes a water flow culvert pipe and a fixed propeller, where the water flow culvert pipe is connected to an end of the main driving device away from a battery cylinder body in a threaded manner, a plurality of water inlet grooves are formed on a circumferential outer wall of the water flow culvert pipe, and the fixed propeller is detachably connected to an outer wall of the projecting shaft of the driving motor, and located inside the water flow culvert pipe.

Preferably, the propulsion structure comprises a waterproof cover, a hub, and two foldable blades, where the waterproof cover is connected to an end of the main driving device away from a battery cylinder body in a threaded manner, the projecting shaft of the driving motor penetrates through the waterproof cover and extends towards the waterproof cover, the hub is detachably connected to the end portion of the projecting shaft of the driving motor, and the two foldable blades are symmetrically and rotatably connected to an end of the hub away from the driving motor.

Preferably, the accelerator control device includes a Bluetooth module and a wireless remote controller, where the Bluetooth module is electrically connected to the electrical interface through a first connecting line wireless remote controller is in signal connection to the Bluetooth module via wireless signals; and a first accelerator trigger is arranged on an outer wall of the wireless remote controller.

Preferably, the accelerator control device is a wired controller, the wired controller is electrically connected to the electrical interface through a second connecting line, and a second accelerator trigger is arranged on an outer wall of the wired controller.

Preferably, the accelerator control device is a handheld bracket, the handheld bracket is detachably connected to a side of a movable block away from a fixing block, and the handheld bracket is inverted U-shaped in side projection; and a third accelerator trigger is arranged at an end of two end portions of the inverted U-shaped "U" handheld bracket, and the handheld bracket is electrically connected to the electrical interface through a third connecting line.

(III) Beneficial Effects

The present disclosure provides a propeller, and has the following beneficial effects:

1. Compared with the prior art, the propeller, foldable blades and a fixed propeller are all detachably connected to a projecting shaft of a driving motor. The foldable blades and the fixed propeller can be easily switched, to meet requirements for different usage scenarios.
2. Compared with the prior art, when the foldable blades are arranged, the propeller can be used as a hydrofoil board booster, and through the clamping plate component, the propeller can be clamped to a vertical rod of the hydrofoil board, and power can be provided to unpowered hydrofoil boards (including hydrofoil boards, hydrofoil wind wing boards, hydrofoil wind surfing boards, hydrofoil paddle boards, and the like). Through the clamping plate component fixed by screws, different sizes of vertical rods can be used, without need of changing the hydrofoil board design. The propeller is centered with the hydrofoil board and is driven to rotate by the driving motor when working. The foldable blades extend to start working and retract along a water flow direction to stop working, which can effectively utilize kinetic energy without prejudice to a balance of hydrofoil board control in a working state and reduce water resistance in a non-working state.
3. Compared with the prior art, when a fixed propeller is surrounded by a water flow culvert pipe provided with water inlet grooves, the propeller can be handheld with a handheld bracket or worn to advance and play underwater. The movable block or the handheld bracket can be combined with various wearing apparatuses, so that the propeller can be bound to an arm, a thigh or a waist of a user. Further, a plurality of propellers can be worn and controlled simultaneously.
4. Compared with the prior art, the propeller can be used as a guiding device for a diving apparatus. Through a connection between a movable block and the existing diving apparatus, and then through a detachable connection between the movable block and a fixing block, quick assembly and disassembly can be achieved. In combination with a gas cylinder and an airbag, the propeller can also be used as a scuba gear. Together with movable and fixed hydrofoil boards, the propeller can also be used as a gliding apparatus for diving.

Compared with the prior art, to meet different electricity consumption needs, different numbers of the battery cells can be configured for the battery cylinder body, depending on the length thereof. The battery cells can provide capacities of 99 Wh, 198 Wh and 297 Wh respectively, and meet the needs of use in a portable and handheld manner and various endurance scenarios. Further, the three the battery cells inside the battery cylinder body can also be disassembled into three separate batteries with a capacity of 99 Wh, respectively, to meet the requirements for portability and airplane travel.

Figure 1:
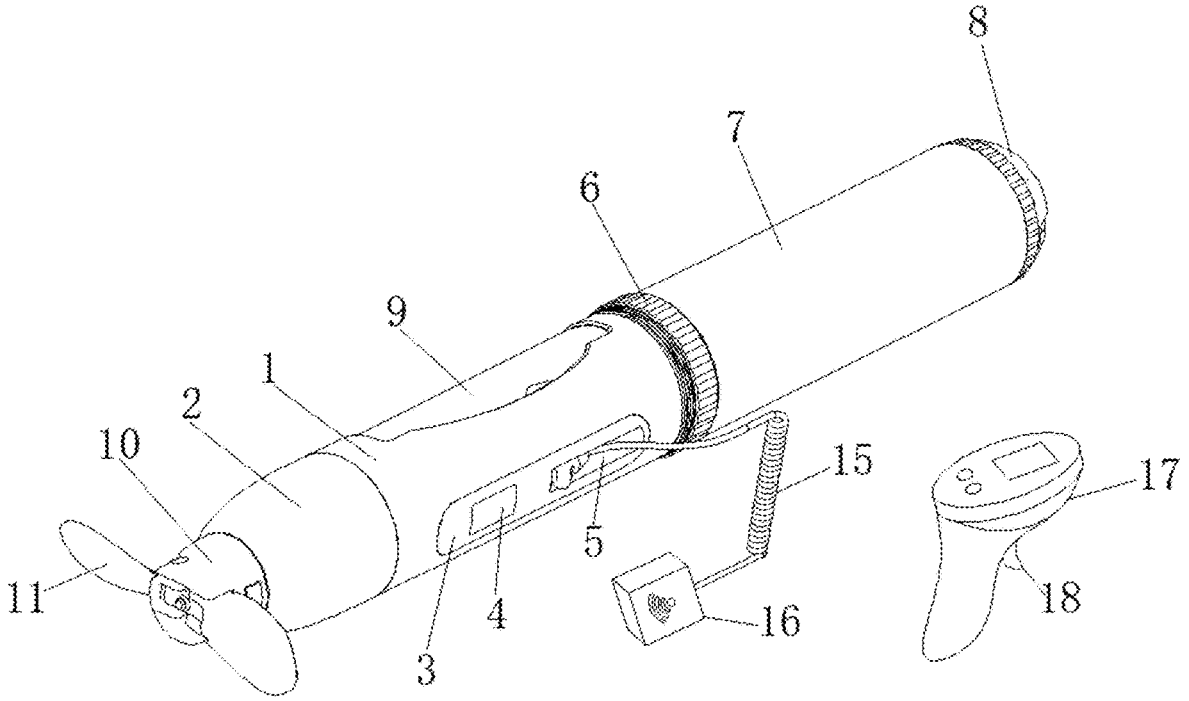
FIG. 1 is a schematic diagram of an overall structure of the present disclosure used as a hydrofoil board booster.

In the figures: 1. main driving device; 2. waterproof cover; 3. control panel; 4. display screen; 5. electrical interface; 6. locking ring; 7. battery cylinder body; 8. bottom cover; 9. clamping plate component; 10. hub; 11. foldable blade; 12. water flow culvert pipe; 13. water inlet groove; 14. fixed propeller; 15. first connecting line; 16. Bluetooth module; 17. wireless remote controller; 18. first accelerator trigger; 19. second connecting line; 20. wired controller; 21. second accelerator trigger; 22. third connecting line; 23. handheld bracket; 24. third accelerator trigger; 25. fixing block; 26. movable block; 27. pressing block; 28. battery cell; 29. first sink; 30. second sink; 31. first clamping buckle; 32. spring; and 33. second clamping buckle.

DETAILED DESCRIPTIONS OF THE EMBODIMENTS

The technical solutions in the embodiments of the present disclosure will be clearly and completely described below in combination with the accompanying drawings in the embodiments of the present disclosure. Apparently, the embodiments described are merely some rather than all of the embodiments of the present disclosure. Based on the embodiments of the present invention, all other embodiments obtained by those of ordinary skill in the art without making creative efforts shall fall within the protection scope of the present invention.

Embodiment 1

As shown in FIGS. 1, 5 and 8-11, in an embodiment of the present disclosure, there is provided a propeller used as a hydrofoil board booster. The propeller includes a main driving device 1, a driving motor is arranged on an inner wall of the main driving device 1, an end portion of a projecting shaft of the driving motor penetrates through a left end of the main driving device 1 and extends towards a left side of the main driving device 1, and a propulsion structure driven by the driving motor is arranged at the left end of the main driving device 1. The propulsion structure includes a waterproof cover 2, a hub 10, and two foldable blades 11, where the waterproof cover 2 is connected to an end of the main driving device 1 away from a battery cylinder body 7 in a threaded manner, the projecting shaft of the driving motor penetrates through the waterproof cover 2 and extends towards the waterproof cover 2, the hub 10 is detachably connected to the end portion of the projecting shaft of the driving motor, and the two foldable blades 11 are symmetrically and rotatably connected to an end of the hub 10 away from the driving motor. The foldable blades 11 extend to start working and retract along a water flow direction to stop working, which can effectively utilize kinetic energy without prejudice to a balance of hydrofoil board control in a working state and reduce water resistance in a non-working state.

Figure 5:
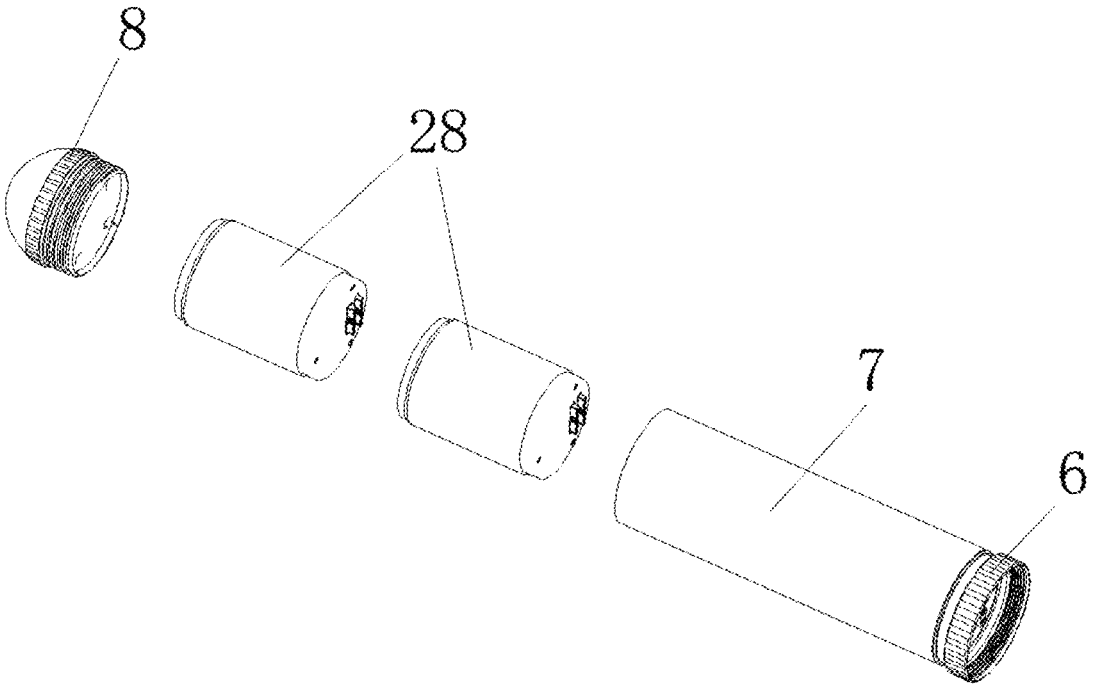
FIG. 5 is a schematic diagram of an explosive structure of a battery cylinder body with two battery cells of the present disclosure.

As shown in FIG. 5, to achieve portability and provide a large-capacity battery, an end of the main driving device 1 away from the propulsion structure, through a locking ring 6, is connected to the battery cylinder body 7 in a threaded manner, an end of the battery cylinder body 7 away from the main driving device 1 is connected to a bottom cover 8 in a threaded manner, and battery cells 28 are arranged on an inner side wall of the battery cylinder body 7. The battery cylinder body 7 varies in length: long, medium, and short. Three, two or one battery cells 28 are arranged inside the long, medium or short battery cylinder body 7, respectively. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel.

As shown in FIG. 1, for easy control of the propeller, a control panel 3 is arranged on a front wall of the main driving device 1, a display screen 4 and an electrical interface 5 are sequentially arranged on a front wall of the control panel 3 from left to right, and the electrical interface 5 is provided with an accelerator control device for controlling the accelerator. The accelerator control device includes a Bluetooth module 16 and a wireless remote controller 17, where the Bluetooth module 16 is electrically connected to the electrical interface 5 through a first connecting line 15, and the wireless remote controller 17 is in signal connection to the Bluetooth module 16 via wireless signals. A first accelerator trigger 18 is arranged on an outer wall of the wireless remote controller 17 and connected to the Bluetooth module 16 through the first connecting line 15, and the Bluetooth module 16 can be fixed on a surface of the hydrofoil board. After the wireless remote control 17 is matched with the Bluetooth module 16, wireless remote control can be achieved.

Figure 8:
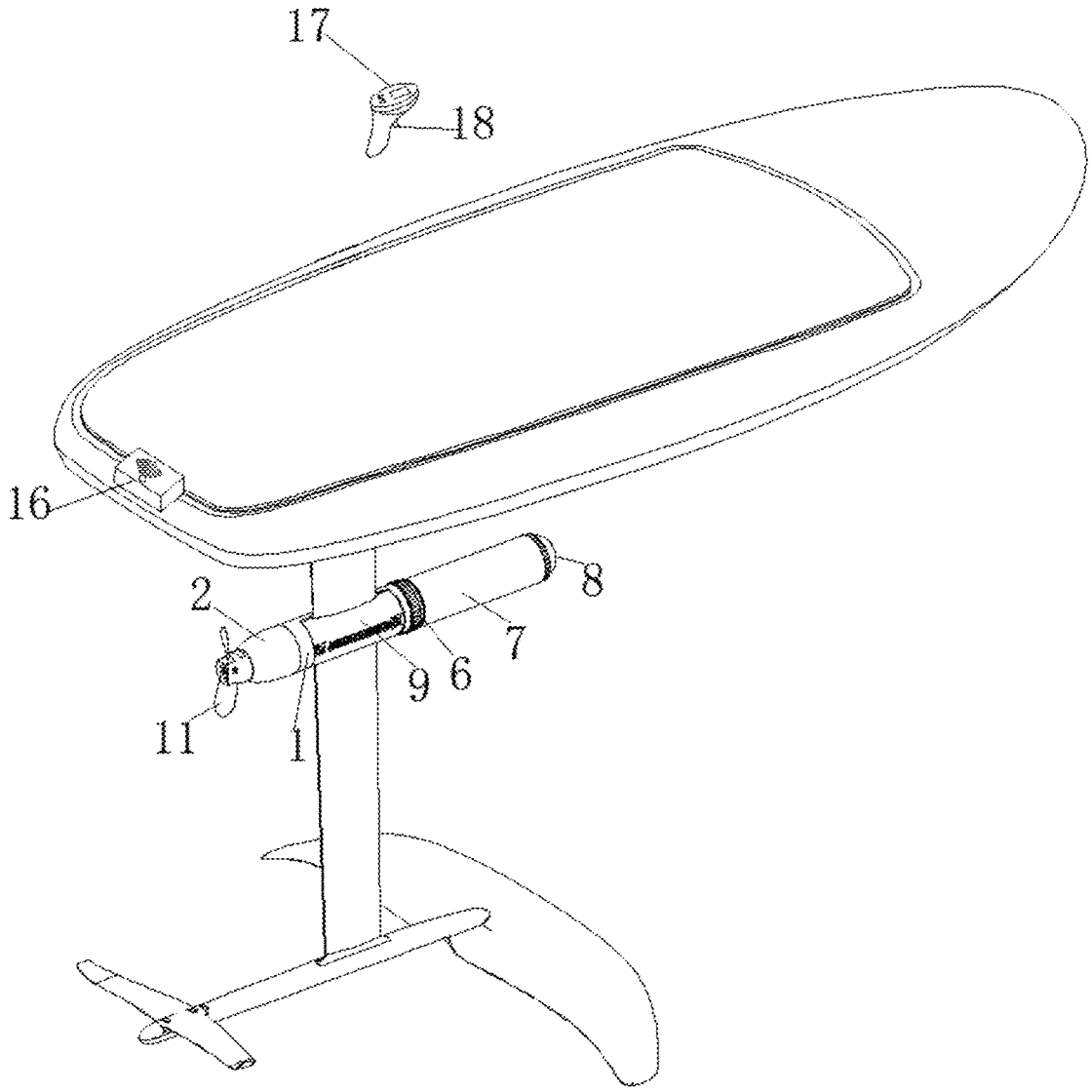
FIG. 8 is a schematic diagram of an overall structure of the present disclosure used as a hydrofoil board booster and installed on a hydrofoil board.
Figure 9:
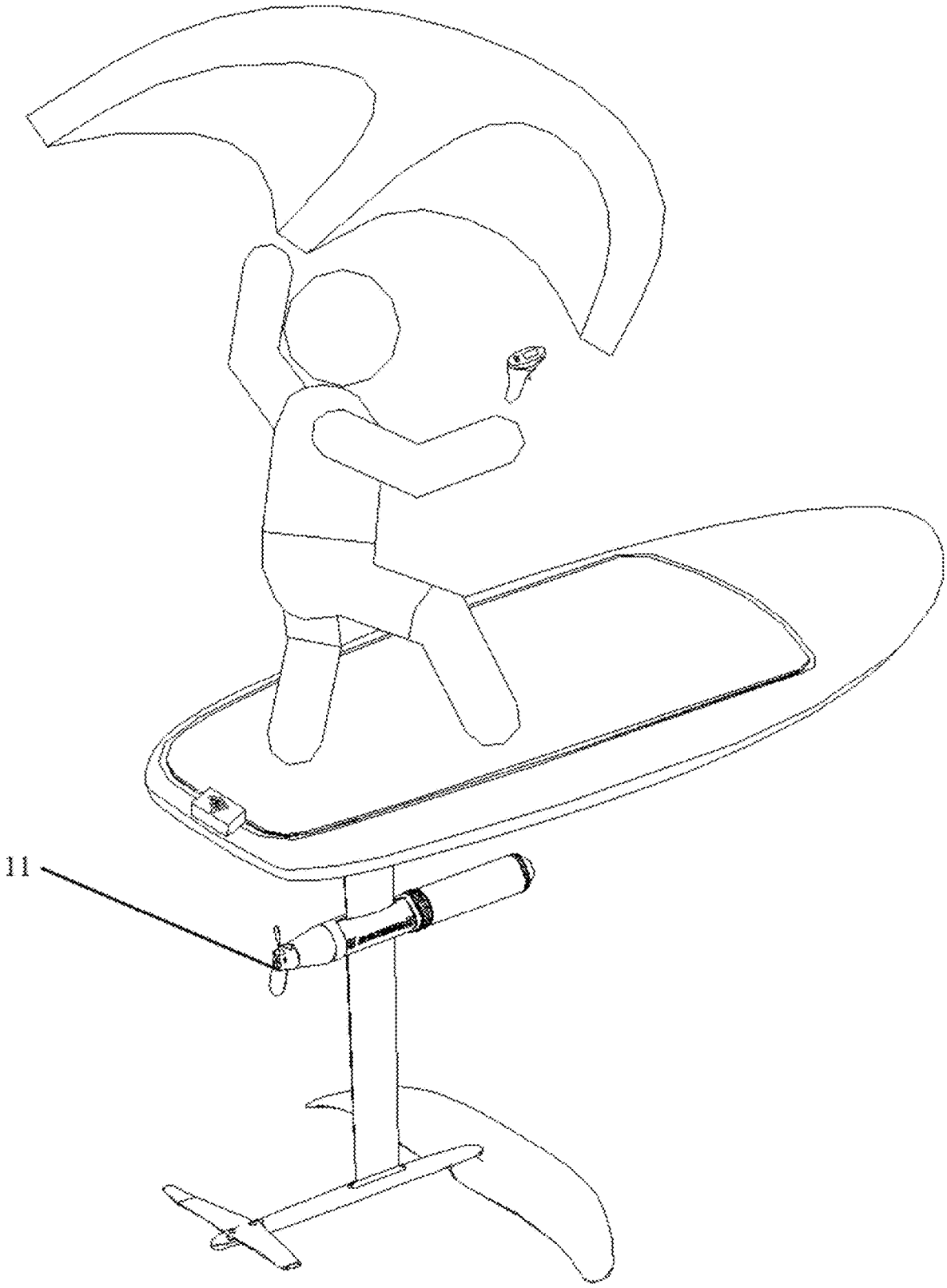
FIG. 9 is a schematic diagram of an overall structure of the present disclosure used as a hydrofoil wind wing board booster and installed on a hydrofoil board.
Figure 10:
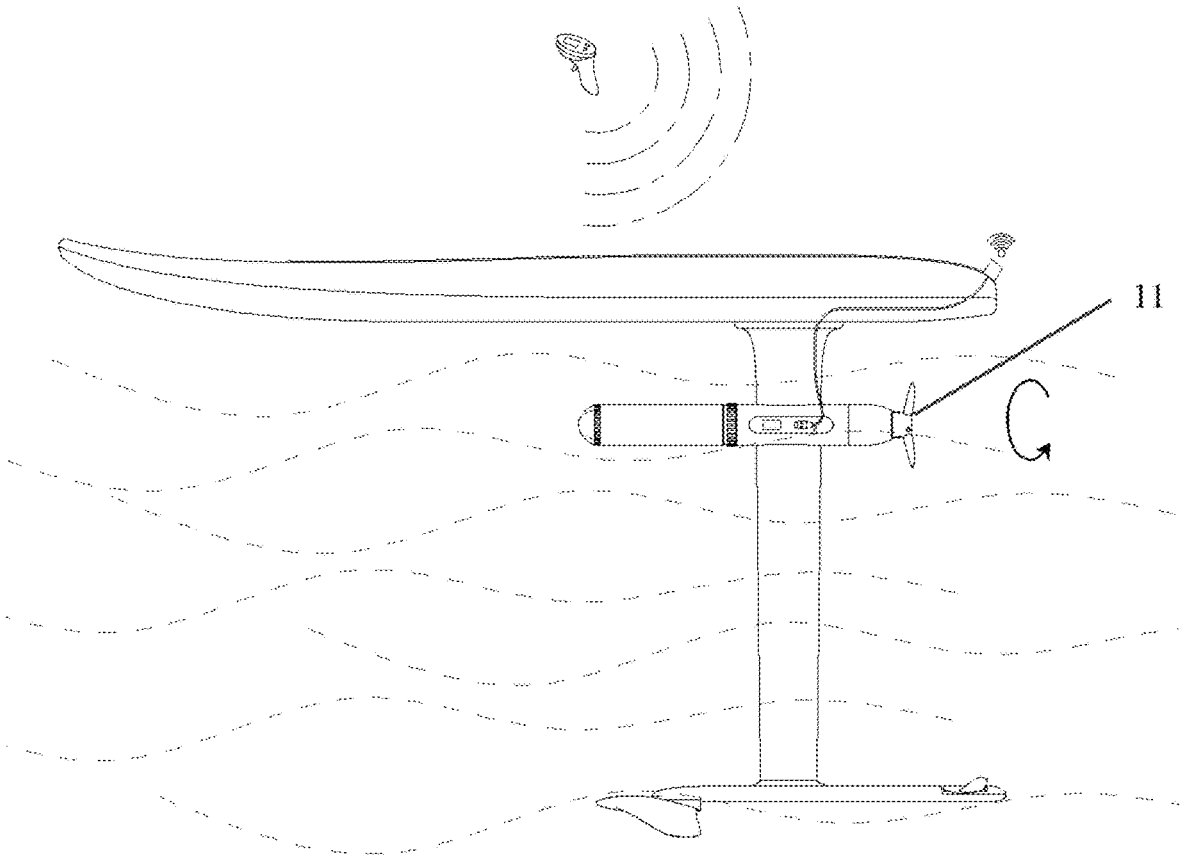
FIG. 10 is a schematic diagram of an overall structure of the present disclosure used as a hydrofoil wind wing board booster and installed in in a working state.
Figure 11:
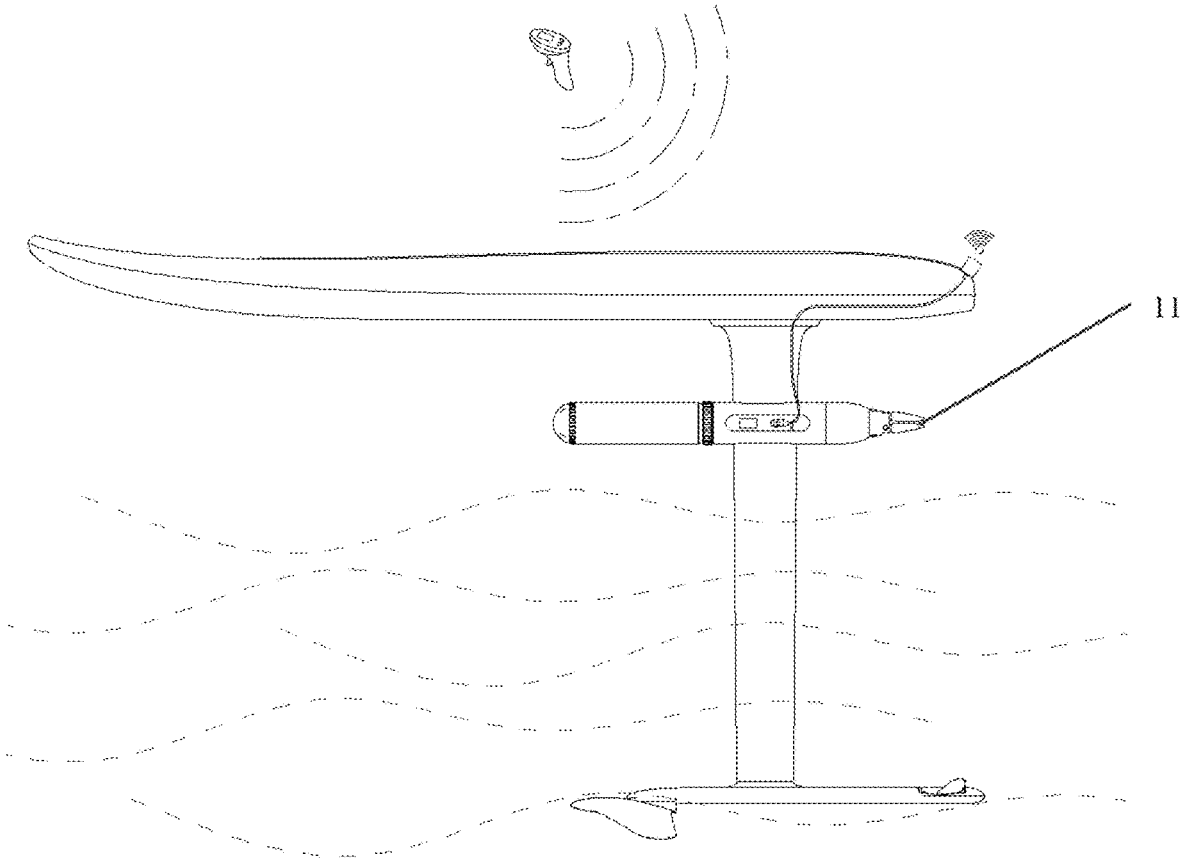
FIG. 11 is a schematic diagram of an overall structure of the present disclosure used as a hydrofoil wind wing board booster and installed in in a non-working state.

As shown in FIGS. 1 and 8, for the purpose of connection to the hydrofoil board, a groove is formed between a rear wall of the main driving device 1 and the control panel 3 that are opposite to each other from front to back, an inner side wall of the groove is fixedly connected with a clamping plate component 9 through screws, and a fixing block 25 is arranged on a rear wall of the clamping plate component 9. One side of the fixing block 25 away from the clamping plate component 9 is detachably connected to a movable block 26, and the propeller can be clamped to a vertical rod of the hydrofoil board through the clamping plate component 9, so that power can be provided to unpowered hydrofoil boards (including hydrofoil boards, hydrofoil wind wing boards, hydrofoil wind surfing boards, hydrofoil paddle boards, and the like). Different sizes of vertical rods can be used, without need of changing the hydrofoil board design.

Embodiment 2

As shown in FIGS. 2, 5, 6 and 7, in an embodiment of the present disclosure, there is provided a used as a diving apparatus aid. The propeller includes a main driving device 1, a driving motor is arranged on an inner wall of the main driving device 1, an end portion of a projecting shaft of the driving motor penetrates through a left end of the main driving device 1 and extends towards a left side of the main driving device 1, and a propulsion structure driven by the driving motor is arranged at the left end of the main driving device 1. The propulsion structure includes a water flow culvert pipe 12 and a fixed propeller 14, where the water flow culvert pipe 12 is connected to an end of the main driving device 1 away from a battery cylinder body 7 in a threaded manner, a plurality of water inlet grooves 13 are formed on a circumferential outer wall of the water flow culvert pipe 12, and the fixed propeller 14 is detachably connected to an outer wall of the projecting shaft of the driving motor, and located inside the water flow culvert pipe 12. The fixed propeller 14 is detachably connected to the projecting shaft of the driving motor, which facilitates replacement. The plurality of water inlet grooves 13 on the outer wall of the water flow culvert pipe 12 facilitate water entry, thereby improving water flow efficiency.

As shown in FIG. 5, to achieve portability and provide a large-capacity battery, an end of the main driving device 1 away from the propulsion structure, through a locking ring 6, is connected to the battery cylinder body 7 in a threaded manner, an end of the battery cylinder body 7 away from the main driving device 1 is connected to a bottom cover 8 in a threaded manner, and battery cells 28 are arranged on an inner side wall of the battery cylinder body 7. The battery cylinder body 7 varies in length: long, medium, and short. Three, two or one battery cells 28 are arranged inside the long, medium or short battery cylinder body 7, respectively. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel.

Figure 2:
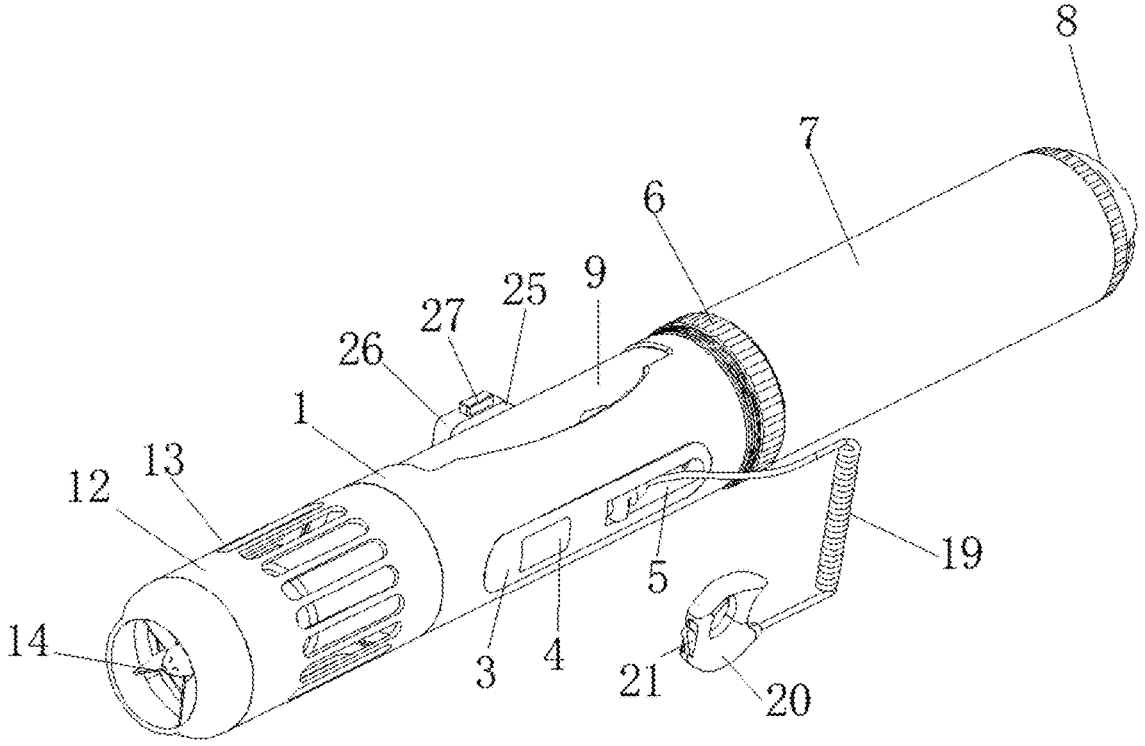
FIG. 2 is a schematic diagram of an overall structure of the present disclosure used as a diving apparatus aid.

As shown in FIG. 2, for easy control of the propeller, a control panel 3 is arranged on a front wall of the main driving device 1, a display screen 4 and an electrical interface 5 are sequentially arranged on a front wall of the control panel 3 from left to right, and the electrical interface 5 is provided with an accelerator control device for controlling the accelerator. The accelerator control device is a wired controller 20, the wired controller 20 is electrically connected to the electrical interface 5 through a second connecting line 19, and a second accelerator trigger 21 is arranged on an outer wall of the wired controller 20. The wired controller 20 can be hand-held to easily control the propeller.

Figure 6:
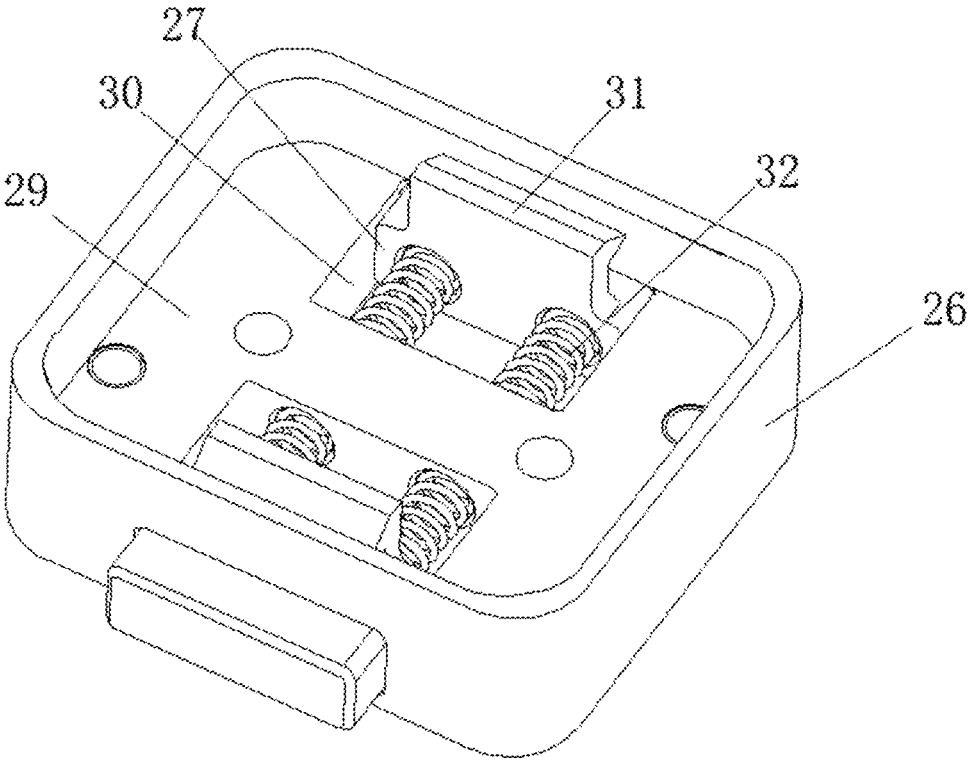
FIG. 6 is a structural schematic diagram of a movable block of the present disclosure.
Figure 7:
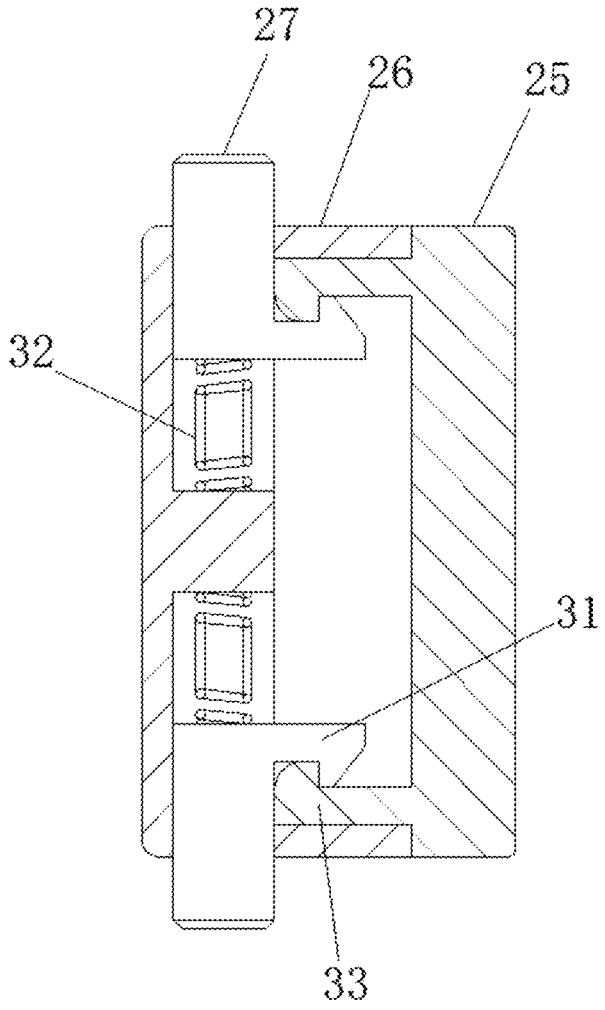
FIG. 7 is a partial sectional view of a side surface of a fixing block and a movable block in a clamping state of the present disclosure.

As shown in FIGS. 2, 6 and 7, to facilitate connection of the propeller to the diving apparatus, a groove is formed between a rear wall of the main driving device 1 and the control panel 3 that are opposite to each other from front to back, an inner side wall of the groove is fixedly connected with a clamping plate component 9 through screws, and a fixing block 25 is arranged on a rear wall of the clamping plate component 9. A side of the fixing block 25 away from the clamping plate component 9 is detachably connected to a movable block 26, two second clamping buckles 33 that are distributed one above the other are arranged on a side of the fixing block 25 away from the clamping plate component 9, and a second hook is arranged at ends of the two second clamping buckles 33 that are opposite to each other and away from the fixing block 25 respectively. A first sink 29 is arranged on a side of the movable block 26 facing the fixing block 25, two second sinks 30 are arranged on an inner rear wall of the first sink 29, and the two second sinks 30 are distributed one above the other. An inner side wall of either of the two second sinks 30 is slidably connected to a pressing block 27, and reverse ends of the two pressing blocks 27 respectively penetrate through an upper wall and a lower wall of the movable block 26 and extend towards an upper side and a lower side of the movable block 26. A first clamping buckle 31 is arranged on a front wall of either of the two pressing blocks 27 and at a position close to an opposite end thereof, both two first clamping buckles 31 extend into the inside of the first sink 29, and a first hook that matches the second hook on the second clamping buckle 33 is arranged on a reverse side of either of the two first clamping buckles 31 and an end away from the pressing block 27. A spring 32 is arranged between an opposite end of either of the two pressing blocks 27 and the inner side wall of the second sink 30. The movable block 26 is detachably connected to the fixing block 25 through the two first clamping buckles 31 and the two second clamping buckles 33. A side of the movable block 26 away from the fixing block 25 can be connected to a common diving apparatus through screws, and quick assembly and disassembly of the propeller with the diving apparatus can be achieved through a detachable connection between the movable block 26 and the fixing block 25.

Embodiment 3

As shown in FIGS. 3, 4, 5, 6 and 7, in an embodiment of the present disclosure, there is provided a propeller used as a handheld propeller. The handheld propeller includes a main driving device 1, a driving motor is arranged on an inner wall of the main driving device 1, an end portion of a projecting shaft of the driving motor penetrates through a left end of the main driving device 1 and extends towards a left side of the main driving device 1, and a propulsion structure driven by the driving motor is arranged at the left end of the main driving device 1. The propulsion structure includes a water flow culvert pipe 12 and a fixed propeller 14, where the water flow culvert pipe 12 is connected to an end of the main driving device 1 away from a battery cylinder body 7 in a threaded manner, a plurality of water inlet grooves 13 are formed on a circumferential outer wall of the water flow culvert pipe 12, and the fixed propeller 14 is detachably connected to an outer wall of the projecting shaft of the driving motor, and located inside the water flow culvert pipe 12. The fixed propeller 14 is detachably connected to the projecting shaft of the driving motor, which facilitates replacement. The plurality of water inlet grooves 13 on the outer wall of the water flow culvert pipe 12 facilitate water entry, thereby improving water flow efficiency. The fixed propeller 14 is arranged inside the water flow culvert pipe 12, and when being used in a handheld manner, the fixed propeller 14 can be protected through the water flow culvert pipe 12, and contact with the fixed propeller 14 is avoided.

As shown in FIG. 5, to achieve portability and provide a large-capacity battery, an end of the main driving device 1 away from the propulsion structure, through a locking ring 6, is connected to the battery cylinder body 7 in a threaded manner, an end of the battery cylinder body 7 away from the main driving device 1 is connected to a bottom cover 8 in a threaded manner, and battery cells 28 are arranged on an inner side wall of the battery cylinder body 7. The battery cylinder body 7 varies in length: long, medium, and short. Three, two or one battery cells 28 are arranged inside the long, medium or short battery cylinder body 7, respectively. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel.

Figure 3:
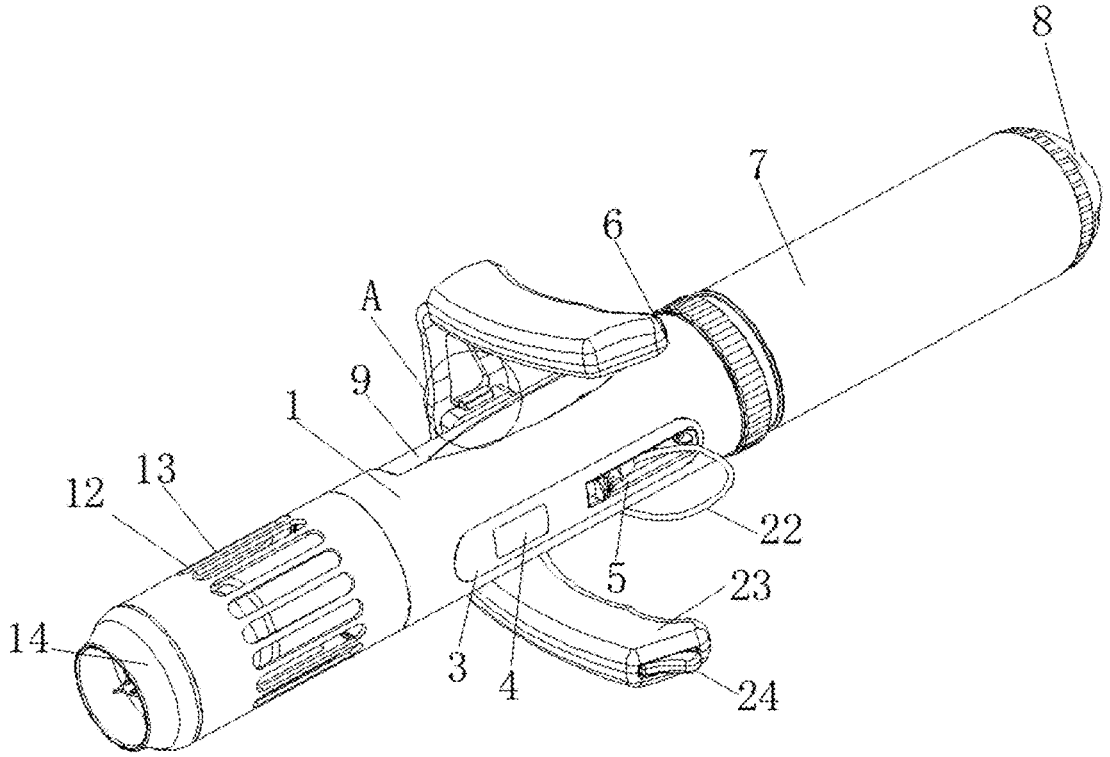
FIG. 3 is a schematic diagram of an overall structure of the present disclosure used as a handheld propeller.
Figure 4:
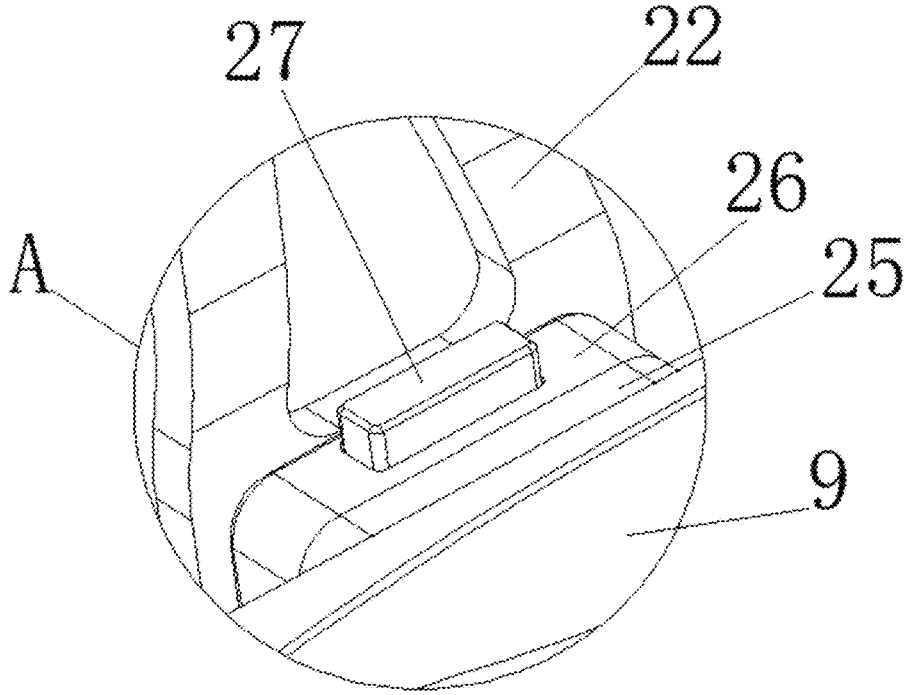
FIG. 4 is a partial enlarged view of a portion A in FIG. 3 of the present disclosure.

As shown in FIG. 3, to facilitate handheld use of a underwater propeller, a control panel 3 is arranged on a front wall of the main driving device 1, a display screen 4 and an electrical interface 5 are sequentially arranged on a front wall of the control panel 3 from left to right, and the electrical interface 5 is provided with an accelerator control device for controlling the accelerator. The accelerator control device is a handheld bracket 23, the handheld bracket 23 is detachably connected to a side of a movable block 26 away from a fixing block 25, and the handheld bracket 23 is inverted U-shaped in side projection. A third accelerator trigger 24 is arranged at an end of two end portions of the inverted U-shaped "U" handheld bracket 23, and the handheld bracket 23 is electrically connected to the electrical interface 5 through a third connecting line 22. A groove is formed between a rear wall of the main driving device 1 and the control panel 3 that are opposite to each other from front to back, an inner side wall of the groove is fixedly connected with a clamping plate component 9 through screws, and a fixing block 25 is arranged on a rear wall of the clamping plate component 9. A side of the fixing block 25 away from the clamping plate component 9 is detachably connected to a movable block 26, two second clamping buckles 33 that are distributed one above the other are arranged on a side of the fixing block 25 away from the clamping plate component 9, and a second hook is arranged at ends of the two second clamping buckles 33 that are opposite to each other and away from the fixing block 25 respectively. A first sink 29 is arranged on a side of the movable block 26 facing the fixing block 25, two second sinks 30 are arranged on an inner rear wall of the first sink 29, and the two second sinks 30 are distributed one above the other. An inner side wall of either of the two second sinks 30 is slidably connected to a pressing block 27, and reverse ends of the two pressing blocks 27 respectively penetrate through an upper wall and a lower wall of the movable block 26 and extend towards an upper side and a lower side of the movable block 26. A first clamping buckle 31 is arranged on a front wall of either of the two pressing blocks 27 and at a position close to an opposite end thereof, both two first clamping buckles 31 extend into the inside of the first sink 29, and a first hook that matches the second hook on the second clamping buckle 33 is arranged on a reverse side of either of the two first clamping buckles 31 and an end away from the pressing block 27. A spring 32 is arranged between an opposite end of either of the two pressing blocks 27 and the inner side wall of the second sink 30. The movable block 26 is detachably connected to the fixing block 25 through the two first clamping buckles 31 and the two second clamping buckles 33. The movable block 26 is connected to common binding straps on the market, and through a detachable connection between the movable block 26 and the fixing block 25, the underwater propeller can be fixed with the binding straps to advance and play underwater. Combined with various common binding apparatuses, the underwater propeller can be bound to an arm, a thigh or a waist of a user. Further, a plurality of underwater propellers can be worn and controlled simultaneously. Through the handheld bracket 23, the underwater propeller can also be used directly in a handheld manner.

Working principle: when the propeller is used as a hydrofoil board booster, two foldable blades 11 are symmetrically and rotatably connected to an end of a hub 10 away from the driving motor. The foldable blades 11 extend to start working and retract along a water flow direction to stop working, which can effectively utilize kinetic energy without prejudice to a balance of hydrofoil board control in a working state and reduce water resistance in a non-working state. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel. Through a first connecting line 15, a Bluetooth module 16 can be fixed on a surface of the hydrofoil board. After a wireless remote control 17 is matched with the Bluetooth module 16, wireless remote control can be achieved. Through the clamping plate component 9, the propeller can be clamped to a vertical rod of the hydrofoil board, and power can be provided to unpowered hydrofoil boards (including hydrofoil boards, hydrofoil wind wing boards, hydrofoil wind surfing boards, hydrofoil paddle boards, and the like). Different sizes of vertical rods can be used, without need of changing the hydrofoil board design.

When the propeller is used as a diving apparatus aid, the fixed propeller 14 is detachably connected to an outer wall of the projecting shaft of the driving motor, and located inside the water flow culvert pipe 12. The fixed propeller 14 is detachably connected to the projecting shaft of the driving motor, which facilitates replacement. The plurality of water inlet grooves 13 on the outer wall of the water flow culvert pipe 12 facilitate water entry, thereby improving water flow efficiency. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel. A wired controller 20 can be hand-held to easily control the propeller. A side of the movable block 26 away from the fixing block 25 can be connected to a common diving apparatus through screws, and quick assembly and disassembly of the propeller with the diving apparatus can be achieved through a detachable connection between the movable block 26 and the fixing block 25.

When the propeller is used as a handheld propeller, the fixed propeller 14 is detachably connected to an outer wall of the projecting shaft of the driving motor, and located inside the water flow culvert pipe 12. The fixed propeller 14 is detachably connected to the projecting shaft of the driving motor, which facilitates replacement. The plurality of water inlet grooves 13 on the outer wall of the water flow culvert pipe 12 facilitate water entry, thereby improving water flow efficiency. The fixed propeller 14 is arranged inside the water flow culvert pipe 12, and when being used in a handheld manner, the fixed propeller 14 can be protected through the water flow culvert pipe 12, and contact with the fixed propeller 14 is avoided. To meet different electricity consumption needs, different numbers of the battery cells 28 can be configured for the battery cylinder body 7, depending on the length thereof. Specifically, one, two and three the battery cells 28 can provide capacities of 99 Wh, 198 Wh and 297 Wh respectively, and meet the needs of use in a portable and handheld manner and various endurance scenarios. Further, the three the battery cells 28 inside the battery cylinder body 7 can also be disassembled into three separate batteries with a capacity of 99 Wh, respectively, to meet the requirements for portability and airplane travel. The movable block 26 is connected to common binding straps on the market, and through a detachable connection between the movable block 26 and the fixing block 25, the underwater propeller can be fixed with the binding straps to advance and play underwater. Combined with various common binding apparatuses, the underwater propeller can be bound to an arm, a thigh or a waist of a user. Further, a plurality of underwater propellers can be worn and controlled simultaneously. Through the handheld bracket 23, the underwater propeller can also be used directly in a handheld manner.

Although the examples of the present disclosure have been illustrated and described, it should be understood that those of ordinary skill in the art may make various changes, modifications, replacements and variations to the above examples without departing from the principle and spirit of the present disclosure, and the scope of the present disclosure is limited by the appended claims and their legal equivalents.

What it claimed is:

1. A propeller, the propeller comprising:

a main driving device, wherein a driving motor is arranged on an inner wall of the main driving device, an end portion of a projecting shaft of the driving motor penetrates through a left end of the main driving device and extends towards a left side of the main driving device, and a propulsion structure driven by the driving motor is arranged at the left end of the main driving device; the propulsion structure is detachable; an end of the main driving device away from the propulsion structure is threaded to a battery cylinder body through a locking ring, an end of the battery cylinder body away from the main driving device is threaded to a bottom cover, and battery cells are arranged on an inner side wall of the battery cylinder body; a control panel is arranged on a front wall of the main driving device, a display screen and an electrical interface are sequentially arranged on a front wall of the control panel from left to right, and the electrical interface is provided with an accelerator control device for controlling an accelerator; a groove is formed between a rear wall of the main driving device and the control panel, the rear wall of the main driving device is opposite to the control panel from front to back, an inner side wall of the groove is fixedly connected with a clamping plate component through screws, and a fixing block is arranged on a rear wall of the clamping plate component; and one side of the fixing block away from the clamping plate component is detachably connected to a movable block.

2. The propeller according to claim 1, wherein two second clamping buckles that are distributed one above the other are arranged on a side of the fixing block away from the clamping plate component, and a second hook is arranged at ends of the two second clamping buckles that are opposite to each other and away from the fixing block respectively; a first sink is arranged on a side of the movable block facing the fixing block, two second sinks are arranged on an inner rear wall of the first sink, and the two second sinks are distributed one above the other; an inner side wall of each of the two second sinks is slidably connected to a pressing block, and reverse ends of the two pressing blocks respectively penetrate through an upper wall and a lower wall of the movable block and extend towards an upper side and a lower side of the movable block; a first clamping buckle is arranged on a front wall of each of the two pressing blocks, both of the two first clamping buckles extend into an inside of the first sink, and a first hook that matches the second hook on the second clamping buckle is arranged on a reverse side of each of the two first clamping buckles and an end away from the pressing block; a spring is arranged between an opposite end of each of the two pressing blocks and the inner side wall of the second sink; the movable block is detachably connected to the fixing block through the two first clamping buckles and the two second clamping buckles.

3. The propeller according to claim 2, wherein a length of the battery cylinder body is variable and different numbers of the battery cells are configured depending on the length of the battery cylinder body.

4. The propeller according to claim 3, wherein the propulsion structure comprises a water flow culvert pipe and a fixed propeller, wherein the water flow culvert pipe is threaded to an end of the main driving device away from the battery cylinder body, a plurality of water inlet grooves are formed on a circumferential outer wall of the water flow culvert pipe, and the fixed propeller is detachably connected to an outer wall of the projecting shaft of the driving motor, and located inside the water flow culvert pipe.

5. The propeller according to claim 3, wherein the propulsion structure comprises a waterproof cover, a hub, and two foldable blades, wherein the waterproof cover is threaded to an end of the main driving device away from the battery cylinder body, the projecting shaft of the driving motor penetrates through the waterproof cover and extends towards the waterproof cover, the hub is detachably connected to the end portion of the projecting shaft of the driving motor, and the two foldable blades are symmetrically and rotatably connected to an end of the hub away from the driving motor.

6. The propeller according to claim 3, wherein the accelerator control device comprises a Bluetooth module and a wireless remote controller, wherein the Bluetooth module is electrically connected to the electrical interface through a first connecting line, and the wireless remote controller is in signal connection to the Bluetooth module via wireless signals; and a first accelerator trigger is arranged on an outer wall of the wireless remote controller.

7. The propeller according to claim 3, wherein the accelerator control device is a wired controller, the wired controller is electrically connected to the electrical interface through a second connecting line, and a second accelerator trigger is arranged on an outer wall of the wired controller.

8. The propeller according to claim 3, wherein the accelerator control device is a handheld bracket, the handheld bracket is detachably connected to a side of the movable block away from the fixing block, and the handheld bracket is inverted U-shaped in side projection; and a third accelerator trigger is arranged at an end of two end portions of the handheld bracket, and the handheld bracket is electrically connected to the electrical interface through a third connecting line.

* * * * *